US005448865A

United States Patent [19]

Palmersten

[11] Patent Number: 5,448,865

[45] Date of Patent: Sep. 12, 1995

[54] PANEL INTERLOCKING MEANS WITH STIFFENER

[76] Inventor: Michael J. Palmersten, 3110 Hillside La., Safety Harbor, Fla. 34695

[21] Appl. No.: 109,770

[22] Filed: Aug. 20, 1993

[51] Int. Cl.[6] ..... E04B 1/80; E04C 1/00

[52] U.S. Cl. ..... 52/309.9; 52/588.1; 52/592.1

[58] Field of Search ..... 52/589.1, 591.1, 592.1, 52/592.2, 309.9, 309.4, 588.1

[56] References Cited

U.S. PATENT DOCUMENTS

| | | | |
|---|---|---|---|
| 3,386,218 | 6/1968 | Scott | 52/309.11 |
| 3,742,672 | 7/1973 | Schaeufele | 52/594 |
| 3,760,548 | 9/1973 | Sauer et al. | 52/593 |
| 4,186,539 | 2/1980 | Harmon et al. | 52/580 |
| 4,769,963 | 9/1988 | Meyerson | 52/309.9 |
| 4,998,396 | 3/1991 | Palmersten | 52/595 |
| 5,086,599 | 2/1992 | Meyerson | 52/309.9 |
| 5,092,095 | 3/1992 | Zadok et al. | 52/593 |
| 5,138,812 | 8/1992 | Palmersten | 52/588.1 |
| 5,216,861 | 6/1993 | Meyerson | 52/309.9 |
| 5,293,728 | 3/1994 | Christopher et al. | 52/588.1 |

*Primary Examiner*—Carl D. Friedman
*Assistant Examiner*—Robert J. Canfield
*Attorney, Agent, or Firm*—Joseph C. Mason, Jr.; Ronald E. Smith

[57] ABSTRACT

Panels having foam cores covered by metal skins are interlocked along their respective sides by forming bent parts in the metal skins that interlock with one another. A first interconnecting member is generally hook-shaped and projects outwardly. Its counterpart is also generally hook-shaped and extends inwardly. The counterpart slideably receives the first interconnecting member, transiently deforming as the first interconnecting member enters it, and returns to its position of repose when the first interconnecting member is fully received therewithin. The foam cores of abutting panels are also sculpted to interlock with one another. An elongate, channel-shaped stiffener member has a flat base and upstanding side walls, at opposite sides of the base, that are received within the area bounded by the hook-shaped outwardly projecting part of the first interconnecting member. This enables construction of modular panels of up to forty feet in length. An elongate bead of caulking compound is positioned between the first and second interconnecting members, below the surface of the panels, and spreads out into interstitial spaces between the first and second interconnecting members when contiguous panels are interconnected to one another.

13 Claims, 8 Drawing Sheets

PANEL INTERLOCKING MEANS WITH STIFFENER

BACKGROUND OF THE INVENTION

1. Field of the invention

This invention relates, generally, to interlockable metal-skinned modular foam panels. More particularly, it relates to a panel design including a stiffener that enables construction of very wide modules.

2. Description of the prior art

Modular panels have broad utility in the construction industry; because of their relative strength and insulating properties, they may be used in a wide variety of applications ranging from roofs for add-on rooms to walls and roofs for walk-in freezers. In their most popular form, they include a core formed of expanded polystryene (EPS) or other suitable material that is protected by a metallic skin. The skin may cover the top only of the core in some applications, or it may cover the top and bottom of the core.

Advantageously, the metal skin may also be used to interlock contiguous panels together. More particularly, it may be bent into different interlocking configurations so that contiguous panels are joined together when their respective metal skins are interlocked with one another.

All of the known designs have utility, but some of the designs include metal formations that are expensive to produce. Some of the designs are very difficult for workers in the field to assemble, and some of the easy-to-assemble designs just as easily come apart, i.e., they have poor sealing properties. Many designs leak when rained upon, even when generous amounts of caulking are applied to the seams between contiguous panels. Thus, the art has tried to develop panels that are inexpensive, easily assembled but held strongly against separation when assembled, and which do not leak.

In typical room add-on or walk-in freezer applications, the panels will be a few inches thick, perhaps eight feet in length, and about four feet in width. The metallic skins of contiguous panels are usually interlocked along their respective lengths; thus, the metal skins may interlock along an eight foot long extent, for example. When panels of greater length are made, they become unacceptably weak. Thus, if an application calls for forty foot long modular panels, for example, the conventional wisdom states that such panels cannot be of the metal skin, foam core type unless provided with additional support. One technique for providing such additional support is the provision of an embedded stiffener within the EPS at the time of manufacture. Such embedding complicates the manufacturing process and produces a heavier panel. The only known alternative to the use of embedded stiffeners is the provision of additional support structures such as additional beams for roof panels, for example. This common expediency obviously increases the cost of the structure.

If a metal skin, foam core panel free of embedded stiffening means having sufficient strength so as to require no additional support even when up to forty feet in length could be produced, it would revolutionize the art. However, when the art is viewed as a whole, it neither teaches nor suggests how such a panel could be provided.

SUMMARY OF THE INVENTION

The very longstanding but heretofore unfulfilled need for a modular panel of the metal skin, foam core type having strength even in extents of up to forty feet is now fulfilled. The novel design also includes an improved interlocking means and overcomes the limitations of prior art caulking techniques as well.

The novel interlocking means may be employed in conjunction with or without interlocking foam core designs, i.e., it has utility in designs where the contiguous foam cores merely abut one another along a flat abutting surface, or where the foam cores are sculpted to interlock with one another in various designs such as tongue and groove designs.

The interlocking means further provides an elongate nook for the placement of an elongate bead of caulking compound so that the seam between contiguous panels is sealed against moisture penetration. The nook is positioned below the surface of the panels and extends the entire length of the seam; it confines the caulking compound to a small, elongate space and thus ensures that the caulking will perform at its maximum capability.

In all of the embodiments of the invention, the metal skin at a first side of the panel has a first ninety degree bend toward the center of the panel formed therein so that a predetermined extent of the side of the foam core is covered by said skin. A second, outwardly directed ninety degree bend is formed at the centermost extent of the skin to thereby form an outwardly protruding, generally hook-shaped interlocking member. An elongate bead of caulking may be applied to the skin where the second ninety degree bend is formed. At the opposite side of the panel, the metal skin that covers the top and bottom (or top only) of the foam core extends, unbent, beyond the side wall of the foam core for a predetermined extent to form the first part of the second interconnecting means. A ninety degree bend toward the center of the panel forms the second part thereof, and said second part extends, parallel to its contiguous foam side wall, for a predetermined extent that is slightly less then the corresponding predetermined extent of the first bent part of the skin at the first side of the panel. A third part, of short predetermined extent, is inclined toward the center of the panel and inwardly at a forty five or so degree angle, and a fourth part, complementally formed with respect to the hook-shaped outwardly protruding part of the first interconnecting member, extends inwardly from said inclined bent part. When contiguous panels are interlocked, the first parts of each interlocking member abut one another along their respective extents and the outwardly protruding part of the first interlocking member is received within the inwardly protruding part of the second interlocking member. The hook-shaped part of the second interlocking member is yieldable but resilient so that it transiently yields to admit the hook-shaped, protruding part of the first interlocking member and returns to its position of repose after fully accepting its counterpart therein, said recessed part capturing said outwardly protruding part against facile retraction when in its position of repose.

An elongate, square U-shaped channel having a flat base and upstanding, longitudinally extending sidewalls at opposite sides of said base provides a stiffening means so that panels up to forty feet in length may be produced. The upstanding walls at the opposite sides of the stiffener are received within the generally hook-shaped space defined by the outwardly projecting part of the first interconnecting member.

Thus, it should be understood that a primary object of this invention is to provide metal skin-covered foam panels having interlocking means of up to forty feet in length.

Another object is to provide an interlocking means that is easy to assemble, but which holds tightly against facile disassembly.

Another object is to provide a panel design that is sealed against moisture penetration by a unique caulking seal.

These and other important objects, features and advantages of the invention will become apparent as this description proceeds.

The invention accordingly comprises the features of construction, combination of elements and arangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
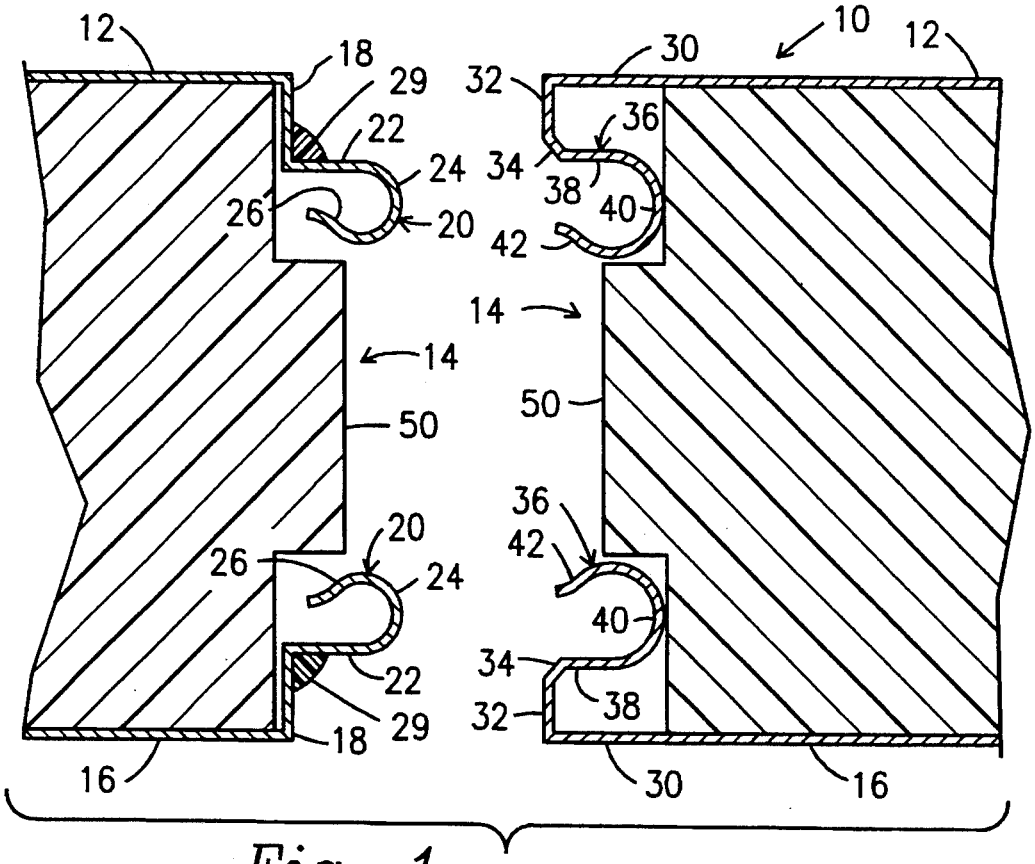
FIG. 1 is a transverse sectional view of a first embodiment of the invention, showing a pair of contiguous panels disposed in spaced apart relation to one another, prior to their interconnection.

Referring now to FIG. 1, it will there be seen that the first illustrative embodiment of the invention is denoted 10 as a whole. Metal skin 12 covers the top of foam core 14 and metal skin 16 covers the bottom thereof. Note the common reference numerals 12, 14, and 16 at the left and right hand sides of FIG. 1; it should be understood that the depicted parts are the opposite sides of a single panel, or the contiguousfsides of abutting panels.

For purposes of clarity and convenience, the interconnecting means at the left side of FIG. 1 will be referred to as the first interconnecting means and its counterpart at the right side of FIG. 1 will be referred to as the second interconnecting means. The direction "centrally" will refer to the direction toward the center of the panel, i.e., from top skin 12 to bottom skin 16, and from bottom skin 16 to top skin 12. "Outwardly" will refer to the direction away from foam core 14, and "inwardly" will refer to the opposite direction.

The first interconnecting means includes a first part 18 that is formed by making a centrally directed ninety degree bend in metal skin 12, 16 at the side wall of foam core 14 so that said first part overlies said side wall as depicted. First part 18 has a predetermined extent which can vary widely. Second part 20 of the first interconnecting means is generally hook-shaped and protrudes outwardly. More particularly, it includes a first straight part 22 that is bent ninety degrees at the centermost end of first part 18 and which extends outwardly, second part 24 that forms a return bend, and third part 26 that forms a gentle S-curve and which extends inwardly. Note that third part 26, in this embodiment, extends inwardly to a point that is coplanar with the plane of first part 18, i.e., its free end almost touches the foam core 14.

An elongate bead of caulking 29 is advantageously placed at the juncture of first part 18 and part 22 of second part 20, along the respective extents thereof.

Figure 2:
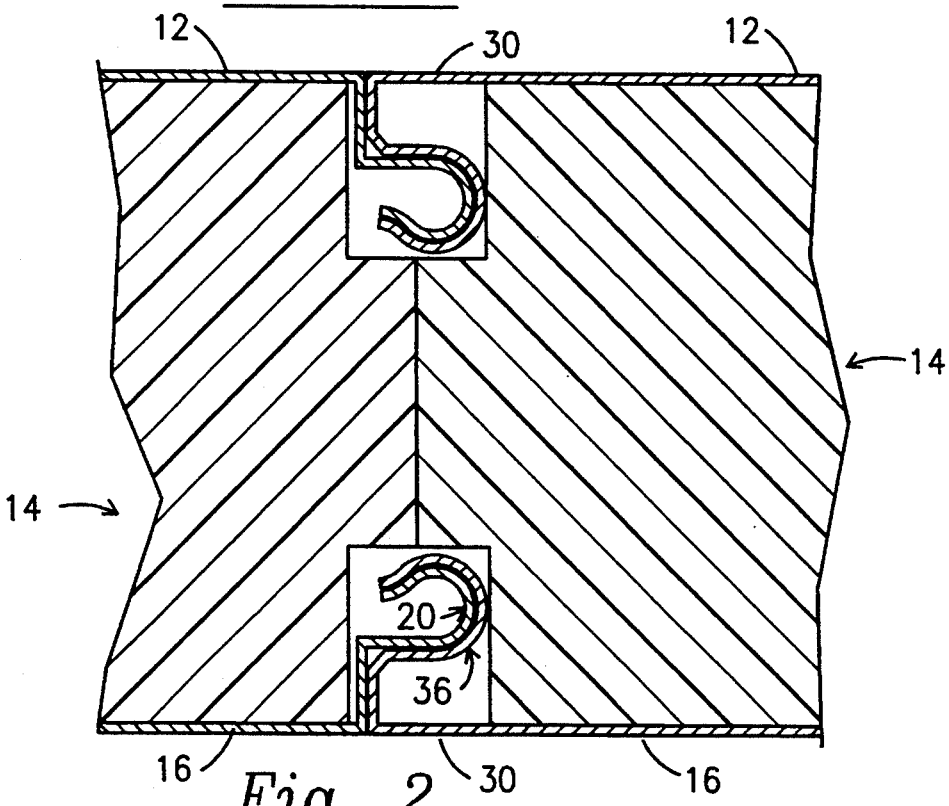
FIG. 2 is a transverse sectional view of said first embodiment, showing said panels in their interlocked configuration.

The second interconnecting means at the right hand side of FIG. 1 includes a first straight part 30, intregral with skin 12, 16, that extends a predetermined distance past the side wall of foam core 14 in coplanar relation to said skin 12, 16, i.e., said skins 12, 16 extend over said foam side wall to form the respective parts 30, 30 as shown. Second part 32 is bent ninety degrees centrally from the outermost end of first part 30, and extends a predetermined distance slightly less than the predetermined extent of first part 18 of the first interconnecting means. Third part 34 is a truncate section of the second interconnecting means; it extends inwardly and centrally in equal measure, i.e, it is angled at about a forty five degree angle. As shown in FIG. 2, third part 34 is so angled so that it may accommodate caulking compound 29 when the first and second interconnecting means are interconnected.

The fourth part of the second interconnecting means is denoted 36 as a whole; it is generally hook-shaped and extends inwardly. Significantly, it is configured and dimensioned to accommodate the outwardly protruding part 20 of the first interconnecting means, as perhaps best understood in connection with FIG. 2. Being metallic, it is yieldable and resilient so that it yields temporarily as part 20 is driven into it at the time of assembly, and returns to its position of repose when part 20 is fully received therewithin; thus, it firmly retains part 20 against facile retraction.

Fourth part 36 includes a first, inwardly directed straight part 38, a return bend 40, and a gentle S-curve-shaped part 42 that extends outwardly. When the first and second interconnecting means are brought together at the construction site, the return bend part 24 of the first interconnecting means transiently displaces the free end of S-curve part 42 of the second interconnecting means. After said return bend part 24 is fully seated against its counterpart, i.e., return bend part 40 of the second interconnecting means, as depicted in FIG. 2, S-curve part 42 returns to its position of repose (its FIG. 1 position) and retains the outwardly directed part 20 of the first interconnecting means within the inwardly extending part 36 of the second interconnecting means. Note in FIG. 2 that the return bend part 24 of the first interconnecting means has a greater breadth than the space between the centralmost end of first part 18 and the free end of S-curve part 26. Note further how S-curve part 42 overlies S-curve part 26 when the panels are interconnected. Both of these structural features prevent facile separation of the first and second interconnecting means.

In this first embodiment, each foam core 14 has an outwardly extending tongue 50 and each tongue has the same extent as its counterpart; the common extent of said tongues is about equal to one-half the extent of the respective outwardly and inwardly extending parts 20, 36 of said first and second interconnecting means. Moreover, each tongue has a flat outermost surface; the abutment of the tongues 50, 50 is shown in FIG. 2.

The metallic skins in all of the remaining embodiments have the same configuration as the metallic skins of the first embodiment; said remaining embodiments differ only in their foam core configurations and thus can be described briefly.

Figure 3:
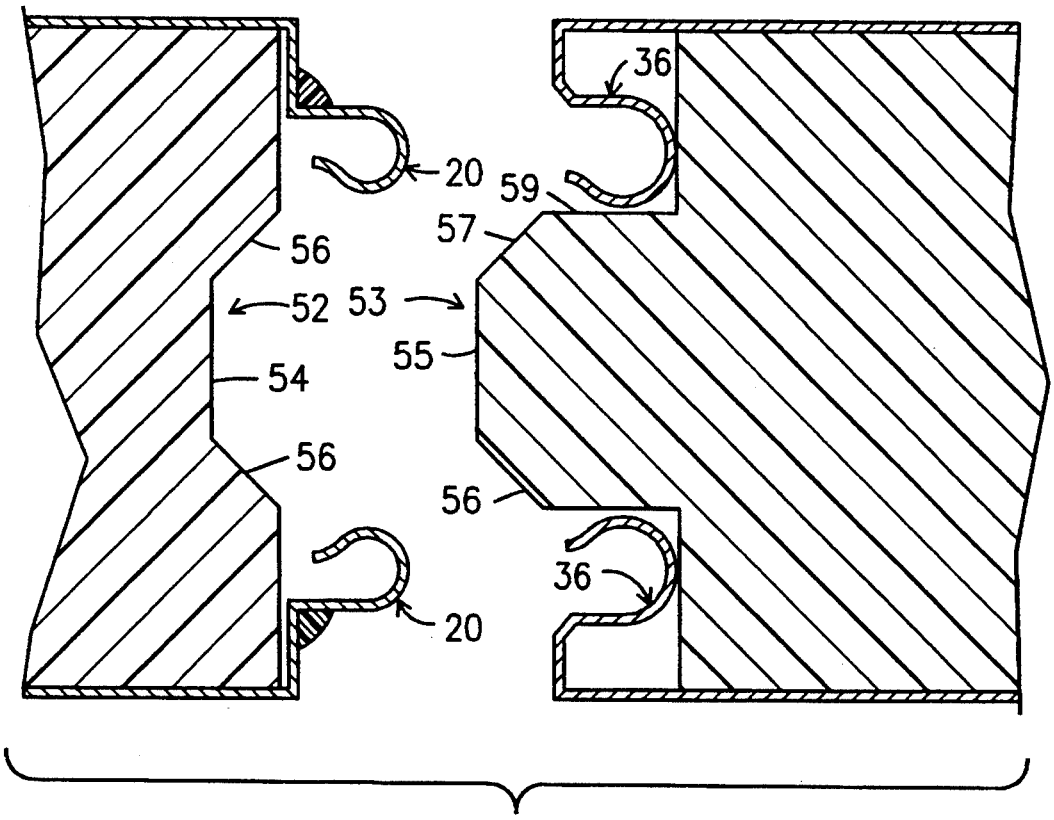
FIG. 3 is a transverse sectional view of a second embodiment of the invention, showing a pair of contiguous panels disposed in spaced apart relation to one another, prior to their interconnection.
Figure 4:
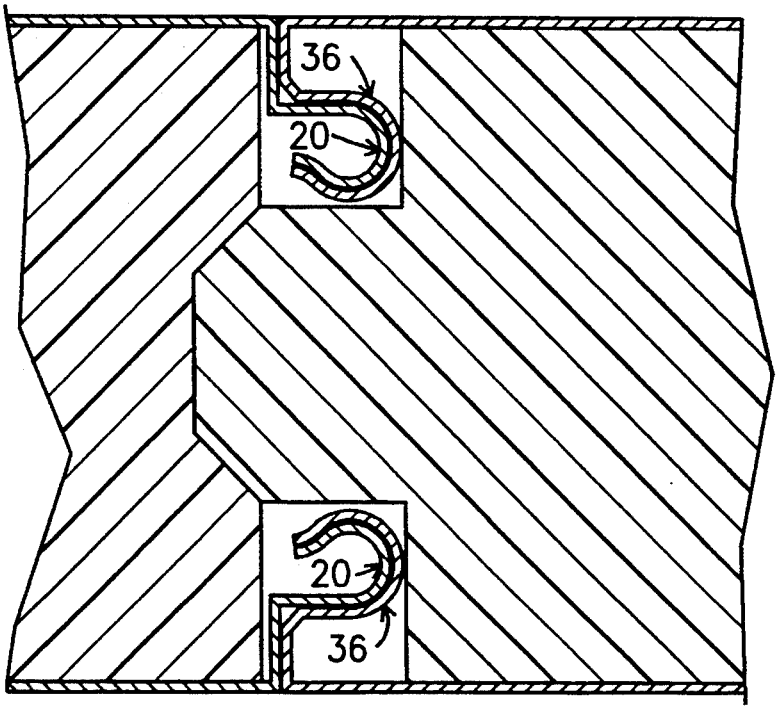
FIG. 4 is a transverse sectional view of said second embodiment, showing said panels in their interlocked configuration.

FIGS. 3 and 4 depict the second embodiment; the foam core associated with the first interconnecting means has a groove 52 with a flat bottom wall 54 and bevelled sidewalls 56 formed therein. Tongue 53 associated with the second interconnecting means has a flat leading wall 55 that abuts flat bottom wall 54 when the panels are interconnected, and bevelled side walls 57 that overlie their bevelled counterparts 56. Note that the straight part 59 of tongue 53 has an extent about equal to the extent of the hook-shaped inwardly projecting part 36 of the second interconnecting means.

Figure 5:
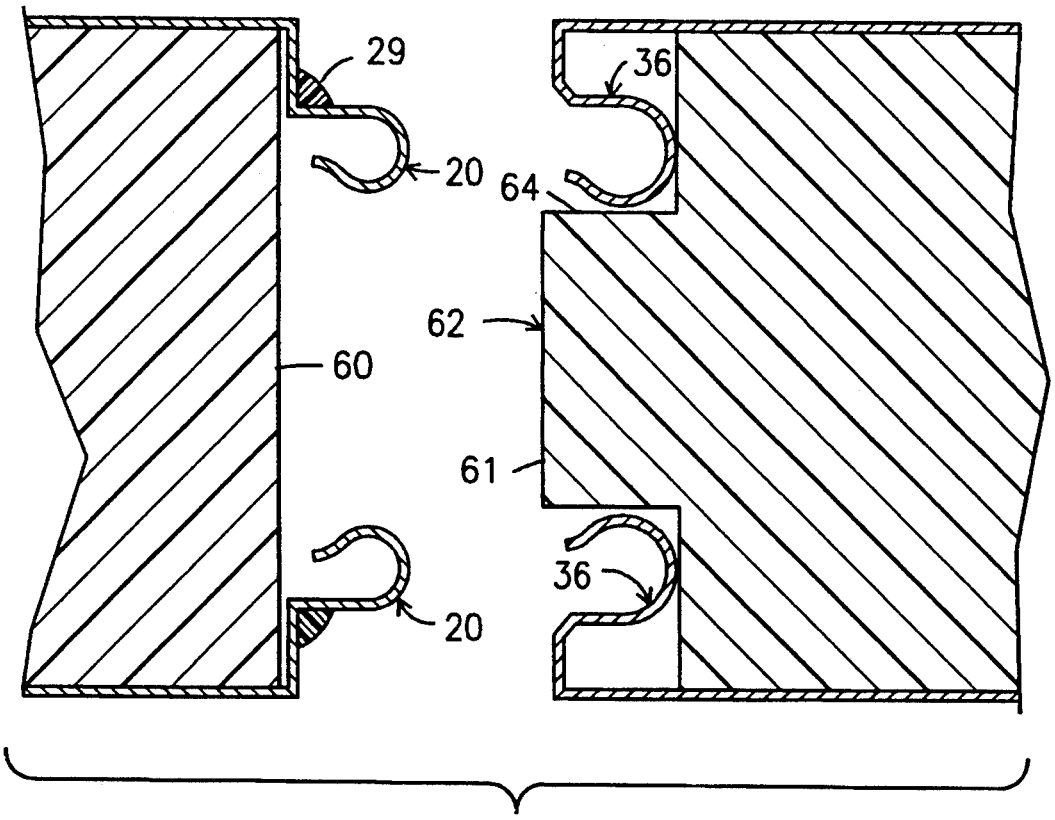
FIG. 5 is a transverse sectional view of a third embodiment of the invention, showing a pair of contiguous panels disposed in spaced apart relation to one another, prior to their interconnection.
Figure 6:
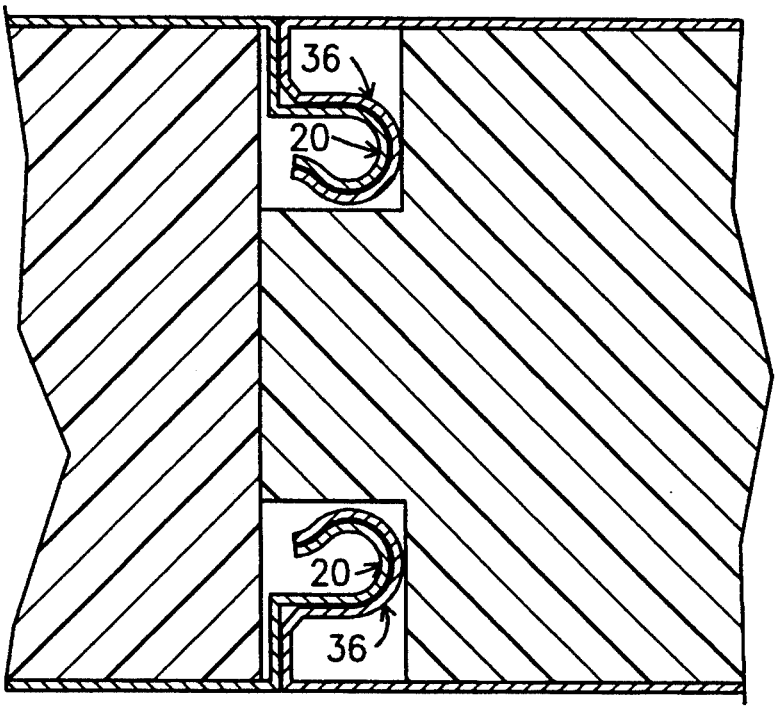
FIG. 6 is a transverse sectional view of said third embodiment, showing said panels in their interlocked configuration.

The third embodiment is depicted in FIGS. 5 and 6. The foam core 14 associated with the first interconnecting means is flat, i.e., unsculpted as at 60, and tongue 62 has a flat leading surface that abuts said surface 60 when the interconnecting means are interlocked as depicted in FIG. 6. The straight part 64 of tongue 62 has an extent approximately equal to the extent of the inwardly directed, hook-shaped part 36 of the second interconnecting means.

Figure 7:
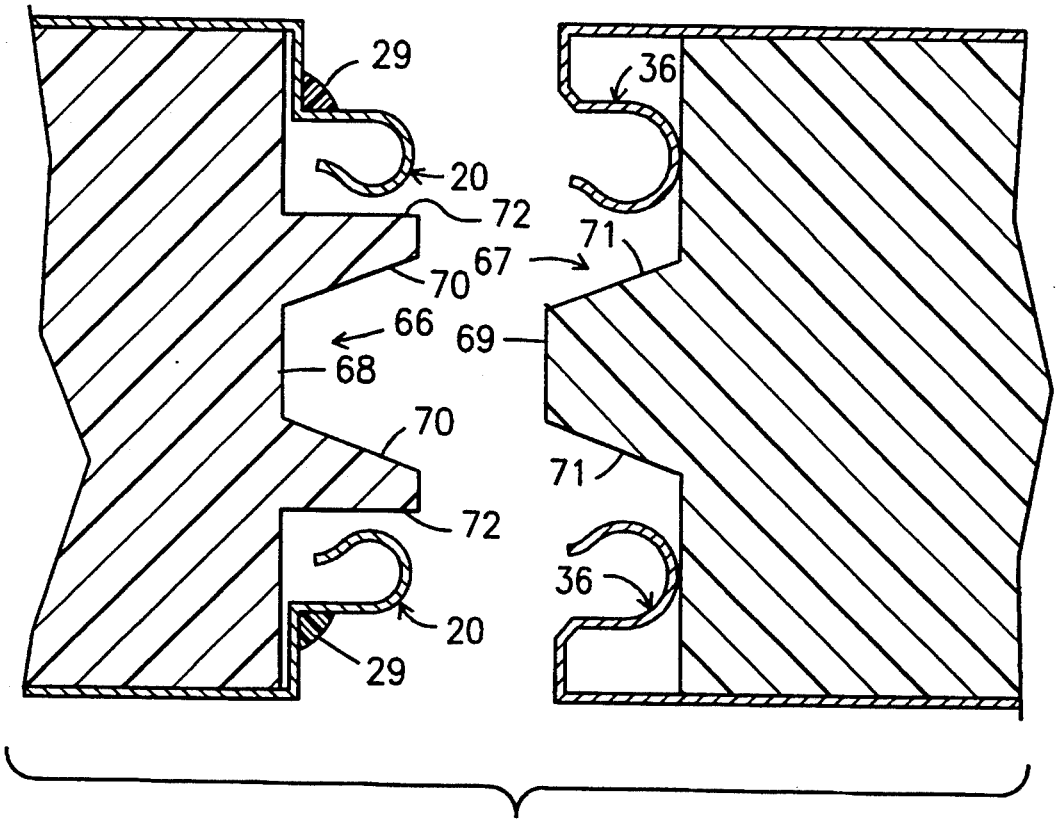
FIG. 7 is a transverse sectional view of a fourth embodiment of the invention, showing a pair of contiguous panels disposed in spaced apart relation to one another, prior to their interconnection.
Figure 8:
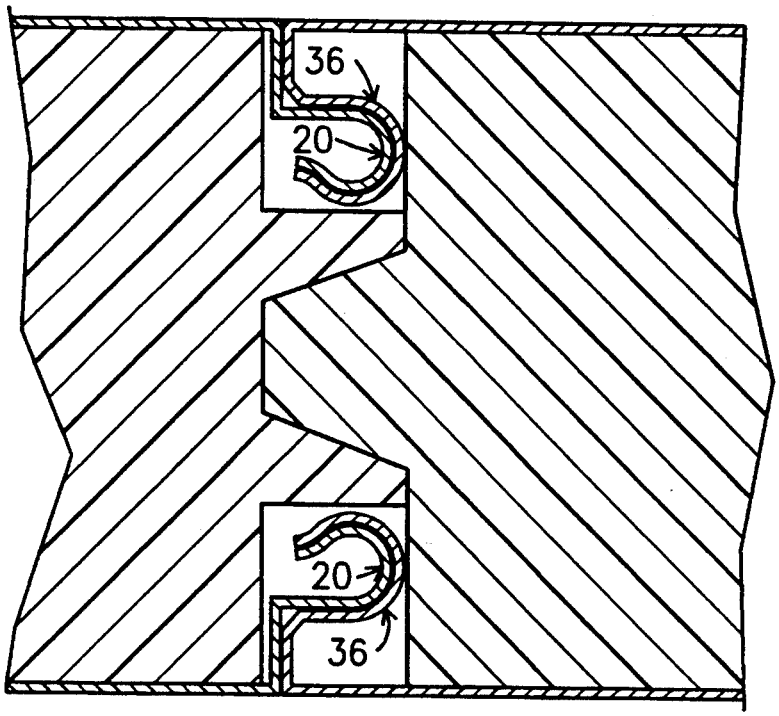
FIG. 8 is a transverse sectional view of said fourth embodiment, showing said panels in their interlocked configuration.

Groove 66 of the fourth embodiment, as depicted in FIGS. 7 and 8, has a flat bottom wall 68 and beveled side walls 70. The groove is formed in an outwardly projecting tongue having straight walls 72 that extend just beyond the extent of hook-shaped part 20 of the first interconnecting means. Groove 66 fully receives tongue 67 of the second interconnecting means as depicted in FIG. 8; it includes flat leading wall 69 that abuts bottom wall 68 and bevelled walls 71 that abut bevelled walls 70 when contiguous panels are interconnected as shown in FIG. 8.

Figure 9:
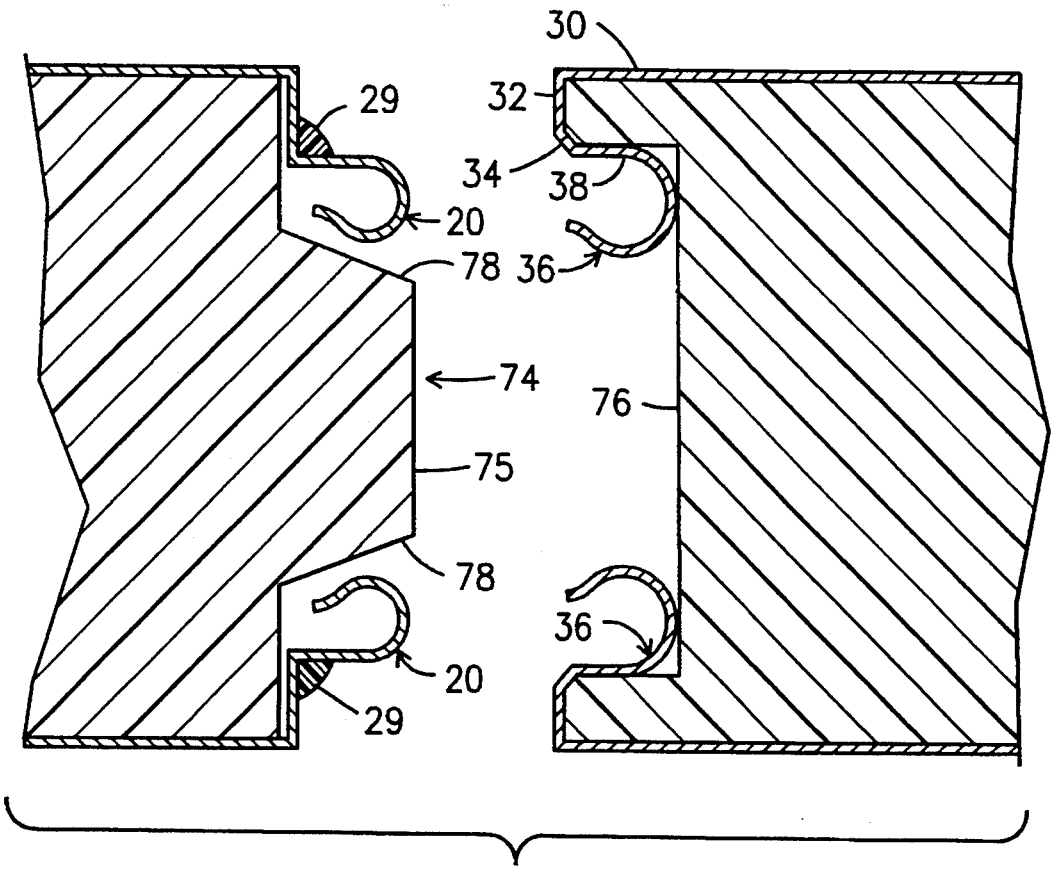
FIG. 9 is a transverse sectional view of a fifth embodiment of the invention, showing a pair of contiguous panels disposed in spaced apart relation to one another, prior to their interconnection.
Figure 10:
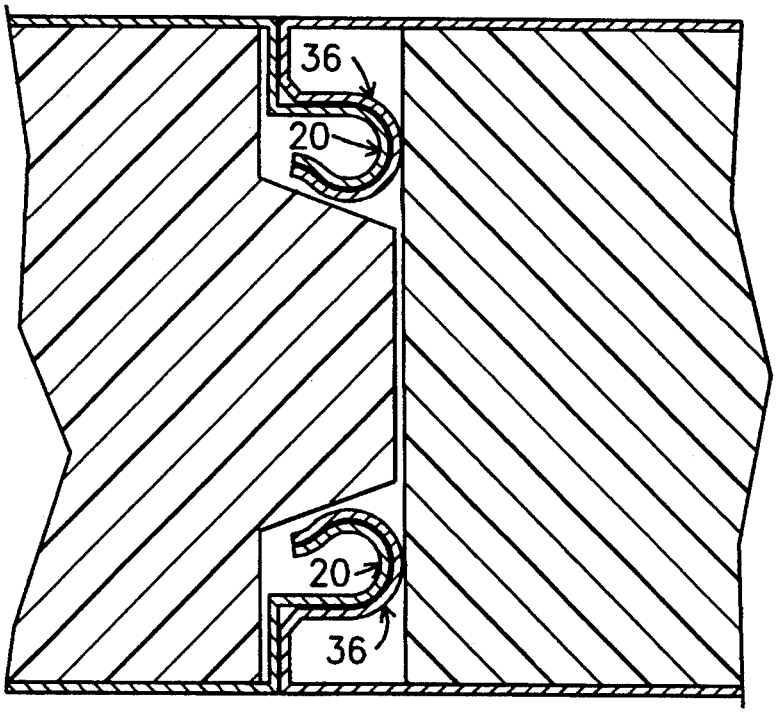
FIG. 10 is a transverse sectional view of said fifth embodiment, showing said panels in their interlocked configuration.

The foam core associated with the second interconnecting means extends outwardly and fills the space bounded by parts 30, 32, 34 and 38 in the fifth embodiment of the invention, as shown in FIGS. 9 and 10. Tongue 74 having bevelled side walls 78 has a leading flat surface 75 that abuts flat surface 76 of the foam associated with the second interconnecting means when contiguous panels are interconnected as depicted in FIG. 10.

Figure 11:
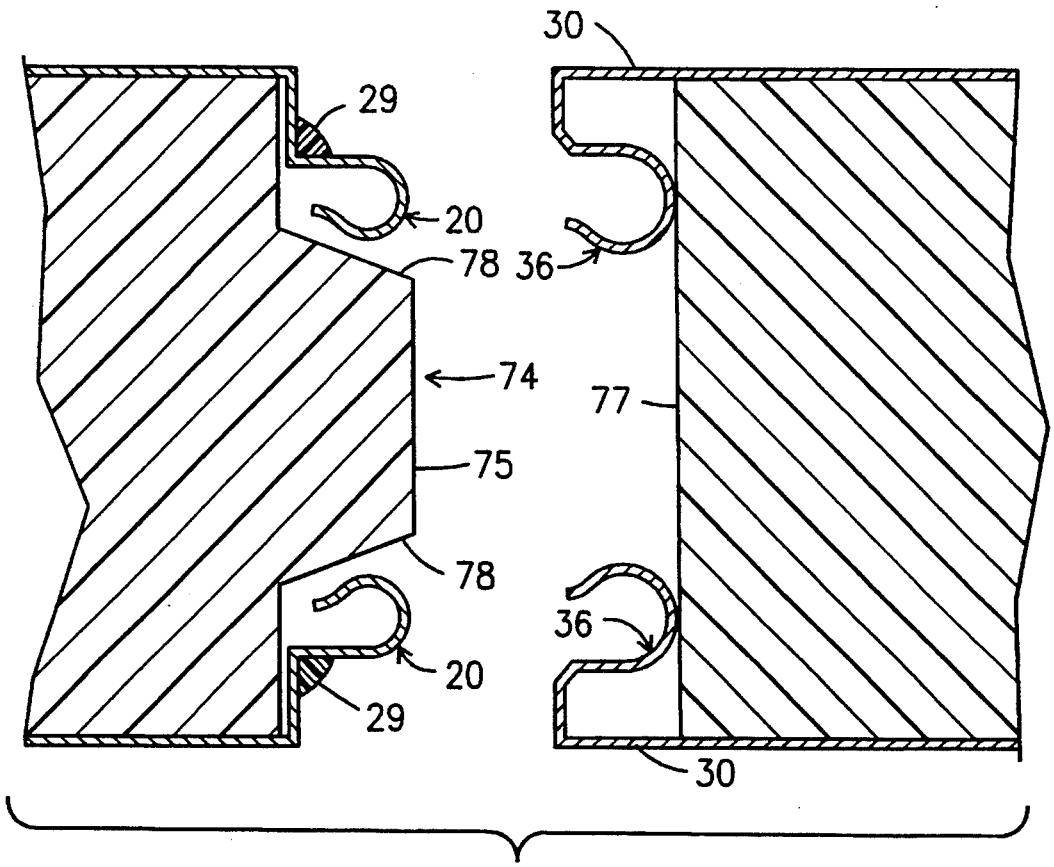
FIG. 11 is a transverse sectional view of a sixth embodiment of the invention, showing a pair of contiguous panels disposed in spaced apart relation to one another, prior to their interconnection.
Figure 12:
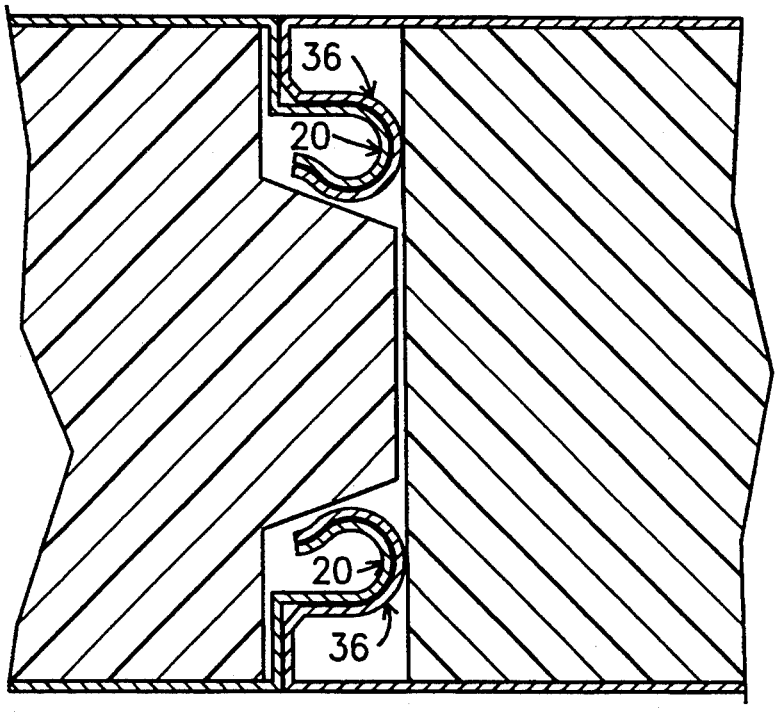
FIG. 12 is a transverse sectional view of said sixth embodiment, showing said panels in their interlocked configuration.

The sixth embodiment is disclosed in FIGS. 11 and 12. The foam associated with the second interconnecting means is unsculpted as at 77; tongue 74 formed in the core associated with the first interconnecting means is the same as the tongue shown in FIGS. 9 and 10.

Figure 13:
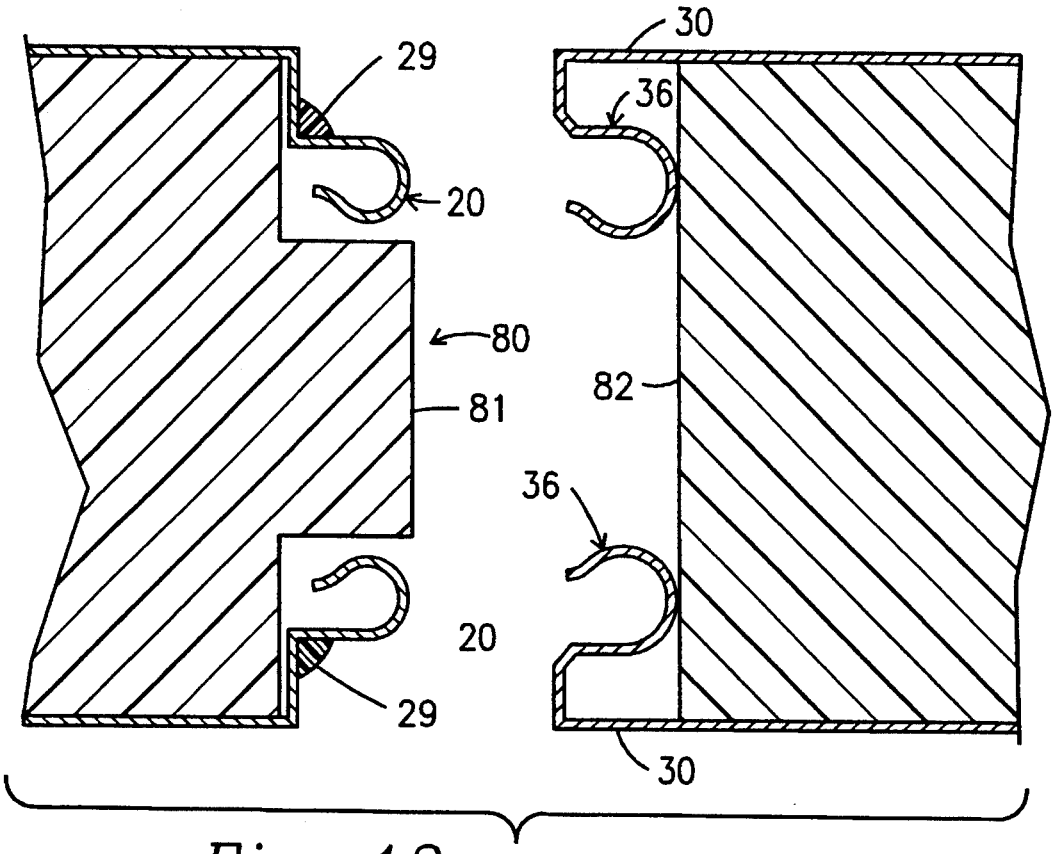
FIG. 13 is a transverse sectional view of a seventh embodiment of the invention, showing a pair of contiguous panels disposed in spaced apart relation to one another, prior to their interconnection.
Figure 14:
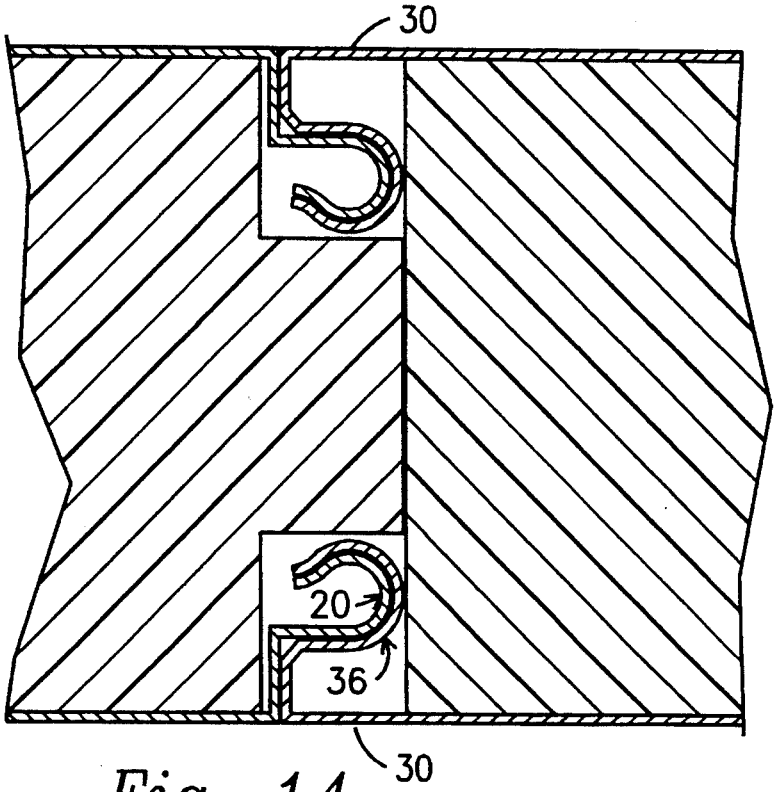
FIG. 14 is a transverse sectional view of said seventh embodiment, showing said panels in their interlocked configuration.

The mirror image of the embodiment of FIGS. 5 and 6 is shown in FIGS. 13 and 14. Tongue 80 having flat leading wall 81 is formed in and extends outwardly from the core associated with the first interconnecting means; it has an extent slightly greater than the extent of outwardly projecting part 20 of the first indicating means, said extent being the extent of straight wall 83. Leading wall 81 of said tongue abuts flat, unsculpted surface 82 of the foam core associated with the second interconnecting means, as shown in FIG. 14.

Figure 15:
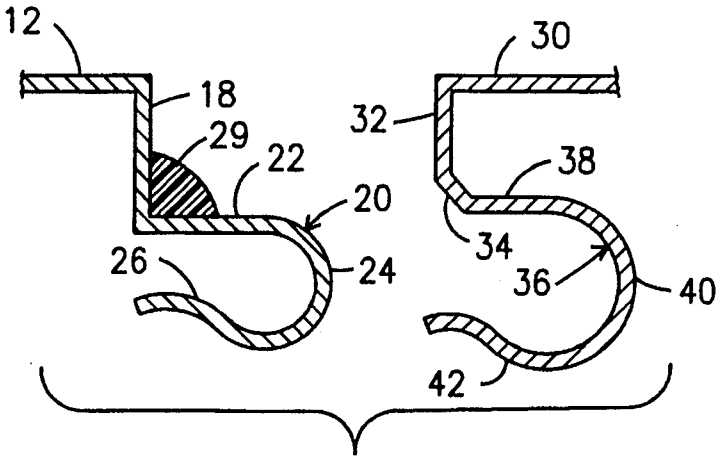
FIG. 15 is an enlarged, broken away transverse sectional view of the first and second interconnecting members disposed in spaced apart relation to one another, prior to their interconnection.
Figure 16:
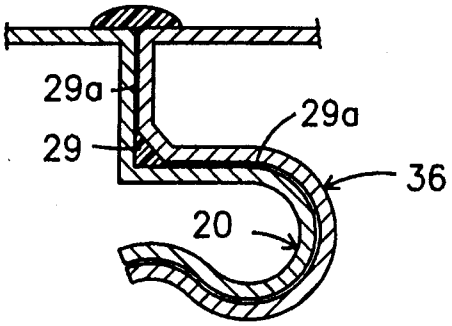
FIG. 16 is a transverse sectional view of the parts shown in FIG. 15 in their interlocked configuration.

The highly novel configuration of the first and second interconnecting means provides the most effective caulking seal ever provided in connection with panels of this type, as will be understood upon an inspection of FIGS. 15 and 16. When the first and second interconnecting means are fully engaged as depicted in FIG. 16, the caulking compound 29 is squeezed between the respective abutting parts thereof; it is therefore forced to branch off into two different directions, as indicated by the reference numerals *29a* and *29b*. Branch *29a* extends between parts 18 and 32 of the first and second connecting means, respectively, and branch *29b* extends between parts 22 and 38 of said respective interconnecting means. The main body of the caulking compound is squeezed tightly between part 34 of the second interconnecting means and parts 18 and 22 of the first interconnecting means. The resulting seal is the first double-branched caulking seal ever achieved in a modular panel environment. It is highly effective, and is not subject to deterioration to the extent of the prior art seals obtained by applying caulking to the exterior of the top and bottom skins along their parting line. Such a prior art seal is shown in FIG. 16 for explanatory purposes only; it is denoted 89 and forms no part of the invention. Exterior seals such as seal 89 fail quickly due to the effects of ultraviolet radiation; compound 29 is not exposed to such radiation. Exterior seals also fail because caulking compound does not perform well in filling narrow, deep cracks such as are formed between modular panels; the enclosed compound 29 is also not subject to such limitation.

Figure 17:
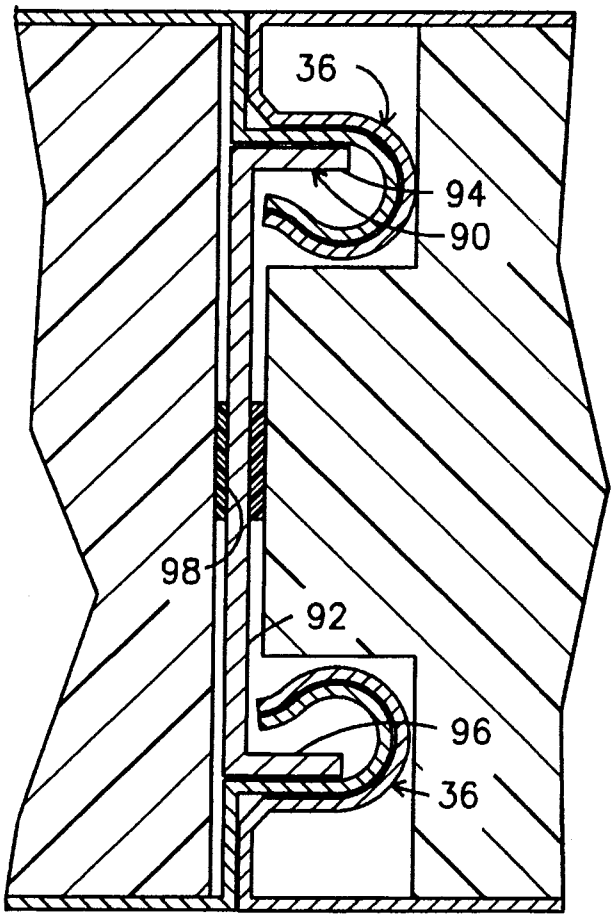
FIG. 17 is a transverse sectional view of contiguous panels disposed in interlocked relation to one another, showing the stiffener means that extends between the top and bottom interconnecting members.

The means for stiffening or reinforcing the novel panels so that they may be manufactured in lengths up to forty feet is depicted in FIG. 17 and is denoted 90 as a whole. It is an elongate, square channel member formed of a suitable rigid material; it includes a flat base 92 and integral, upstanding side walls 94, 96 disposed at right angles to said base. The extent of said side walls is slightly less than the extent of the outwardly projecting part 20 of the first interconnecting means so that said side walls are fully accommodated within their associated outwardly projecting part 20 as shown. Note that base 92 is substantially coplanar with centrally-directed bent part 18 of the first interconnecting means. Note further that the respective S-curve parts 26 and 42 of the first and second interconnecting means have been truncated to accommodate stiffener 90. Advantageously, stiffener 90 not only stiffens and supports the first interconnecting means within which it is disposed, it also strengthens and supports the second interconnecting means as well since said first and second interconnecting means are nested together as depicted. Thus, the amount of rigidity introduced into the interlocked panels is substantial and enables a major breakthrough in the art of modular panel construction, i.e., said stiffener enables construction of panels of the type herein disclosed in lengths up to forty feet.

Reference numeral 98 indicates a moisture barrier means that performs the function its name expresses; it is important in walk-in freezer applications and serves to prevent condensation on the exterior surface of the panels. Its construction is well known to those of ordinary skill in the art to which it pertains. Note that it is shown in section in FIG. 17; it wraps completely around base 92 of stiffener 90.

Many other embodiments of this invention will now be apparent to those of ordinary skill in view of these multiple illustrations of exemplary embodiments, and all of said suggested embodiments are within the scope of this invention.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A modular panel, comprising:

a foam core having a flat top surface and a flat bottom surface;

a top metallic skin for covering said top surface;

a bottom metallic skin for covering said bottom surface;

said foam core having opposite sides formed by side walls that are disposed normal to said top and bottom surfaces;

said top and bottom metallic skins at a first side of said panel being bent to form a first interconnecting means;

said top and bottom metallic skins at a second side of said panel being bent to form a second interconnecting means;

said first interconnecting means of said panel being adapted for interconnection to an adjacent panel and said second interconnecting means of said panel being adapted for interconnection to an adjacent panel when said panel is interlocked between adjacent panels;

said first interconnecting means of said panel including a first bent part of predetermined extent that is bent ninety degrees in a direction toward the center of said panel;

said first interconnecting means of said panel including a second, outwardly projecting, generally hook-shaped part of predetermined extent;

said second part including a first, outwardly projecting part that is bent ninety degrees relative to said first bent part, a return bend part, and an S-curve part that extends inwardly, said first, outwardly projecting part and said inwardly-extending S-curve part having a substantially common extent;

said second interconnecting means of said panel including a first unbent part that extends a predetermined extent outwardly of said second side of said panel;

said second interconnecting means of said panel further including a second part that is bent ninety degrees and which extends a predetermined extent toward the center of said panel, a third part that extents a predetermined extent toward the center of said panel and inwardly in substantially equal amounts, and a fourth, generally hook-shaped part that extends inwardly a predetermined extent.

2. The modular panel of claim 1, wherein said fourth, generally hook-shaped part of said second interconnecting means includes a first straight part of predetermined extent that extends inwardly in parallel relation to said first unbent part, a return bend part, and an outwardly-extending S-curve part, said inwardly extending first part and said outwardly-extending S-curve part having a substantially common extent.

3. The modular panel of claim 2, wherein said fourth, generally hook-shaped part of said second interconnecting means has a position of repose where a space between its first straight part and a free end of its S-curve part has less breadth than a breadth of said return bend part of said first interconnecting means so that said space is transiently widened upon introduction of said second, outwardly projecting, generally hook-shaped part of said first interconnecting means into the generally hook-shaped fourth part of said second interconnecting means, said fourth, part of said second interconnecting means of said panel generally hook-shaped being resilient so that it substantially returns to its position of repose when said second part of said first interconnecting means is fully received therewithin, said substantial return to said position of repose serving to interlock said first interconnecting means and said second interconnecting means.

4. The modular panel of claim 1, wherein an elongate bead of caulking compound is disposed on said first interconnecting means where said first part and said second part of said panel interconnecting means are joined with one another, and wherein said caulking compound is squeezed between said first and second interconnecting means when said first and said first adjacent first are interconnected to one another.

5. The modular panel of claim 1, further comprising an outwardly projecting tongue formed in each of said opposite sides of said foam core, each of said tongues having a predetermined extent substantially equal to about one-half the predetermined extent of said outwardly projecting part of said first interconnecting means.

6. The modular panel of claim 1, further comprising a groove formed in the foam core associated with said first interconnecting means, said groove having a flat bottom and bevelled side walls, and further comprising an outwardly projecting tongue formed in the foam core associated with said second interconnecting means, said outwardly projecting tongue having a leading end that conforms to the configuration of said groove and said tongue having a combined extent substantially equal to the depth of said groove and the extent of said second hook-shaped part of said first interconnecting means.

7. The modular panel of claim 1, further comprising a tongue formed in said foam core associated with said first interconnecting means, and wherein said foam core associated with said first interconnecting means is flat, said tongue having a flat leading end adapted to abut squarely against said flat foam core, and said tongue having a predetermined extent substantially equal to the extent of said hook-shaped second part of said first interconnecting means.

8. The modular panel of claim 1, further comprising an outwardly projecting tongue member formed in said foam core associated with said first interconnecting means, a groove formed in said outwardly projecting tongue member, said groove having a depth substantially equal to the extent of the outward projection of said tongue, said groove having a flat bottom and bevelled side walls, and a second tongue formed in said foam core associated with said second interconnecting means of said first adjacent panel, said second tongue being formed complementally with respect to said groove.

9. The modular panel of claim 1, further comprising an outwardly projecting tongue formed in said foam core associated with said first interconnecting means of said panel, wherein said foam core associated with said second interconnecting means has a flat-bottomed groove formed therein, and wherein said foam core associated with said second interconnecting means is adapted for extension into a space bounded by the first, second, third, and fourth parts of said second interconnecting means of an adjacent panel, said tongue having bevelled side walls, having a flat leading surface adapted to abut said flat-bottomed groove formed in said foam core, and having a predetermined extent substantially equal to the outwardly extending extent of said second outwardly projecting part of said first interconnecting means of said panel.

10. The modular panel of claim 1, further comprising an outwardly projecting tongue formed in said foam core associated with said first interconnecting means, wherein said foam core associated with said second interconnecting means is flat, said tongue having bevelled side walls, having a flat leading surface that is adapted to squarely abut said flat foam core, and having a predetermined extent substantially equal to the outwardly extending extent of said second outwardly projecting part of said first interconnecting means.

11. The modular panel of claim 1, further comprising an outwardly projecting tongue formed in said foam core associated with said first interconnecting means, wherein said foam core associated with said second interconnecting means, said tongue having squared side walls, having a flat leading surface that is adapted to squarely abuts said flat foam core, and having a predetermined extent substantially equal to the outwardly extending extent of said second outwardly projecting part of said first interconnecting means.

12. The modular panel of claim 7, further comprising an elongate, rigid, channel-shaped stiffening means having a flat main body and upstanding wall members at opposite ends of said main body that are disposed normal thereto, said upstanding wall members being positioned within a space bounded by the hook-shaped second part of said first interconnecting means of said panel, said flat main body overlying said flat foam core associated with said first interconnecting means of said panel, respective S-curve parts of said first interconnecting means of said panel being truncated to accommodate said main body of said stiffener means.

13. The modular panel of claim 12, further comprising a moisture barrier wrapped around said main body of said stiffener means.

* * * * *